United States Patent [19]

Adachi

[11] Patent Number: 4,493,084

[45] Date of Patent: Jan. 8, 1985

[54] BELT SYNCHRONOUS CHECK SYSTEM FOR A LINE PRINTER

[75] Inventor: Tomomichi Adachi, Kawasaki, Japan

[73] Assignee: Fujitsu Limited, Kawasaki, Japan

[21] Appl. No.: 415,930

[22] Filed: Sep. 8, 1982

[30] Foreign Application Priority Data

Sep. 10, 1981 [JP] Japan ..... 56/142926

[51] Int. Cl.[3] ..... B41J 1/20

[52] U.S. Cl. ..... 371/67

[58] Field of Search ..... 371/67; 364/183, 571

[56] References Cited

U.S. PATENT DOCUMENTS

| | | | |
|---|---|---|---|
| 3,066,601 | 12/1962 | Eden | 371/67 X |
| 3,845,709 | 11/1974 | Gardiner | 101/93 C |
| 4,027,764 | 6/1977 | Kashio | 371/67 X |
| 4,425,844 | 1/1984 | Carrington et al. | 371/67 X |

OTHER PUBLICATIONS

Burke et al., Print Error Detector, IBM Technical Disclosure Bulletin, vol. 13, No. 3, 8/70, p. 664.

IBM Technical Disclosure Bulletin, "Automatic Belt Recognition and Character Sequencing in a Belt Printer", by Faflak et al., vol. 16, No. 8, 1/74, pp. 2431-2432.

*Primary Examiner*—Jerry Smith

*Assistant Examiner*—M. Ungerman

*Attorney, Agent, or Firm*—Staas & Halsey

[57] ABSTRACT

A line printer which comprises a standard type-belt (1) having a plurality of character sets (2), clock (CL) marks for individual characters, and home position (HP) marks for each character set. Further, the line printer comprises a belt image memory (13') for storing the character codes of the characters of the type-belt (1). Flag bits are inserted at positions of the belt image memory (13') corresponding to the reference marks of the character sets (2). Further, the output (HP-D) of the belt image memory (13') is compared with the output (HP) of the type-belt (1) to perform a belt synchronous check.

5 Claims, 4 Drawing Figures

HP-D
13'
15''
24
241
242
CL
25
256
255
253
251
252
254
CL
HP
17
MPU
HP
26
22
C N T
27
21
MXC
CL
MPU

BELT SYNCHRONOUS CHECK SYSTEM FOR A LINE PRINTER

BACKGROUND OF THE INVENTION

1. Field of the Invention

The present invention relates to a line printer and, more particularly, to a belt synchronous check system for a line printer.

2. Description of the Prior Art

In a prior art line printer using a type-belt changing system or a train cartridge changing system, standard type-belts may be replaced by the operator. For example, a standard 64-character type-belt comprises 6 sets of 64 characters, and a standard 96-character type-belt comprises 4 sets of 96 characters. That is, each standard type-belt comprises a total of 384 characters. In such a standard type-belt, a home position (HP) mark is provided for each character set, and a clock (CL) mark is provided for each character.

Usually, the line printer comprises an interface for responding to a center machine, a print data buffer (PDB) for receiving print data from the center machine, a belt image memory (BIM) for storing standard belt character codes, detectors for the HP and CL marks on the running type-belt, a belt synchronous circuit, a hammer mechanism, and the like.

The line printer operates as follows. If the printer is in a normal state, the printer enters into a data transfer mode. In this mode, print data is transferred from the center machine through the interface to the PDB. The data transfer is terminated when the PDB receives a definite number of data, 136 digits of data, or when the center machine stops sending the print data. After this data transfer mode is completed, the printer enters into a print mode. In the print mode, the BIM is scanned by reference to CL signals and HP signals generated from the type-belt mechanism. At this stage, the character code of the BIM corresponding to the character in front of the hammer is compared with the character at each position, and as a result, when a matching character is found, the hammer is activated so as to print the character. This processing is carried out for all the positions.

The above-mentioned operation is usually carried out after the characters on the type-belt have been synchronized with the content of the BIM. However, a mismatching will occur in the synchronization between the type-belt and the BIM if any of the following phenomena develop:

1. The number of characters per set is not equal to a predetermined value, such as 384, when an HP mark is detected.

2. An HP mark is not detected when the number of characters reaches the predetermined value, such as 384.

In order to carry out a belt synchronous check, a decoder is provided in the belt synchronous circuit for checking whether or not the number of characters reaches a predetermined value. When the number of characters reaches the predetermined value, the decoder generates a second home position (HP-D) signal which is compared with a first HP signal obtained from an HP mark. If a mismatching is generated between the two signals, the printer indicates that there is a possibility of character errors, missed characters, or the like in the preceding two or three lines.

In the above-mentioned prior art, however, since such a predetermined value which determines the number of standard type-belts, is set by, the number of wire connections of the input terminals of the decoder, therefore, the number of predetermined values, that is, the number of standard type-belts available is limited.

SUMMARY OF THE INVENTION

It is, therefore, an object of the present invention to provide a belt synchronous check system in a line printer in which any number of type-belts is available.

According to the present invention, there is provided a belt synchronous check system for a line printer including a type-belt having a plurality of character sets each of which has the same characters, first means for generating signals indicating the locations of individual character, second means for generating signals indicating the reference marks of the character sets, and a belt image memory for storing the character codes of the characters, the system comprising: counter means for counting the signals from the first signal means; flag-generating means, provided in the belt image memory, having flag bits which are inserted at positions corresponding to the reference marks of the character sets; determination means for comparing the output of the flag-generating means indicated by the counter means with the signals from the second signal means; and control means for receiving the output of the determination means to indicate the matching state between the type-belt and the belt image memory, the control means clearing the counter means upon receipt of the first output of the second signal generating means.

The present invention will be more clearly understood from the description as set forth below contrasting the present invention with the prior art and referring to the accompanying drawings.

DESCRIPTION OF THE PREFERRED EMBODIMENT

Figure 1:
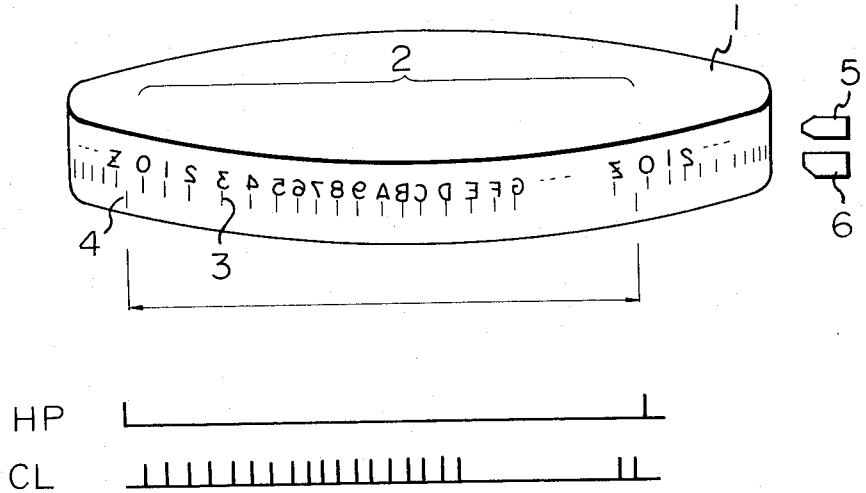
FIG. 1 is a schematic diagram of a standard type-belt.

In FIG. 1, a standard type-belt 1 comprises a character arrangement divided into a plurality of character sets 2, each of which has the same characters. In addition, the type-belt 1 comprises CL marks 3 for each character and HP marks 4 for each character set 2. A magnetic detector 5 detects CL marks 3 to generate CL signals, while a magnetic detector 6 detects HP marks 4 to generate HP signals.

There are various kinds of standard type-belt such as a 48-character type-belts (8 sets×48 characters), a 64-character type-belt (6 sets×64 characters), a 96-character type-belt (4 sets×96 characters) a 128-character type-belt (3 sets×128 characters), and the like.

Figure 2:
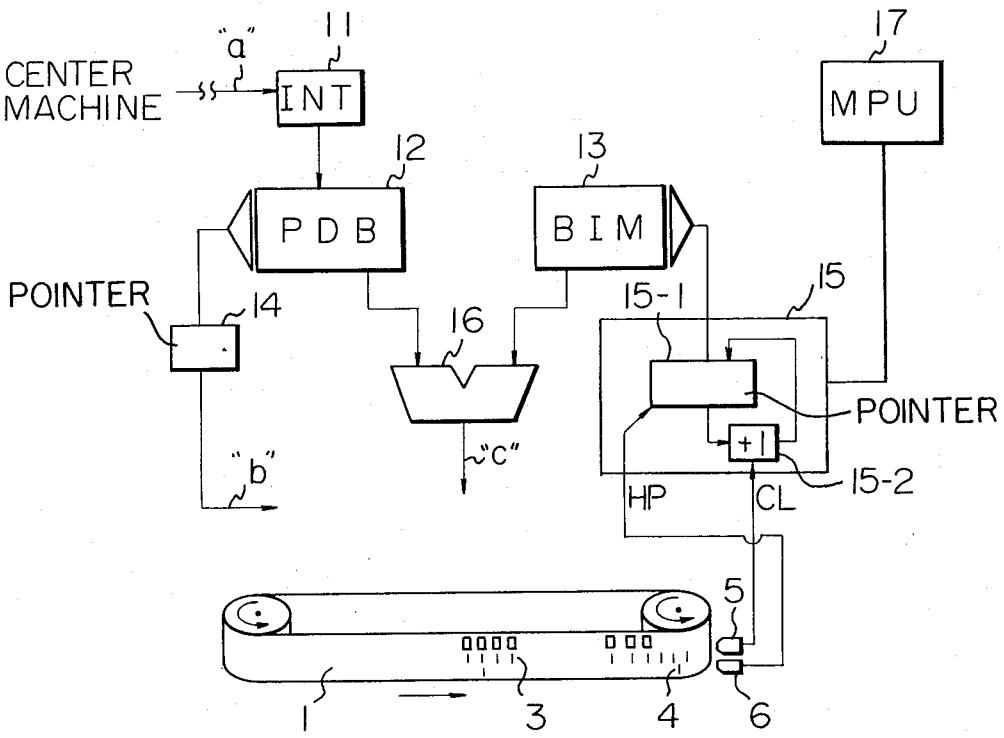
Fig. 2 PRIOR ART
FIG. 2 is a block circuit diagram of a prior art print control circuit.

In FIG. 2, which is a prior art print control circuit, reference numeral 11 designates an interface for responding to a center machine (not shown); 12 on PDB; 13 a BIM; 14 a pointer for indicating an address of the PDB 12; 15 a belt synchronous circuit formed by a pointer 15-1 for indicating an address of the BIM 13, and an address shifter 15-2; 16 a comparator; and 17 a microprocessor (MPU) for controlling the entire printer. In addition, "a" designates print data from the center machine; "b" a hammer address signal for selecting a hammer driving circuit; and "c" a hammer setting and resetting signal for activating and deactivating the corresponding hammer driving circuit.

The operation of the print control circuit of FIG. 2 will now be explained.

The center machine generates a write command to the MPU 17, the control proceeds to a data transfer mode if the printer is in a normal state. That is, print data is transferred from the center machine through the interface to the PDB 12. In this case, print data that is not provided on the type-belt 1 is received by the PDB 12, and a blank is inserted in the corresponding area of the PDB 12. The data transfer is terminated when the PDB 12 receives 136 digits of print data or the center machine stops sending the print data.

Note that the character codes corresponding to the characters are stored in the BIM 13 in advance. It is preferable that the BIM 13 be constructed of a read-only memory (ROM). In this case, ROMs are prepared for individual type-belts.

The control proceeds to a print mode which print the data received from by the PDB 12. In this print mode, the BIM 13 is scanned by using CL signals and HP signals. That is, the type-belt 1 is tracked or synchronized by the BIM 13 with the aid of the belt synchronous circuit 15. The comparator 16 compares the content of the PDB 12 with the content of the BIM 13 and, as a result, when the two contents are the same, the comparator 16 generates a hammer setting and resetting signal "c" to the hammer driving circuit. In this case, the pointer 15-1 generates an address of the BIM 13, while the pointer 14 generates an address of the PDB 12 as well as a hammer address "b". When such comparison of all the contents of the PDB 12 is carried out, the printing of a line is completed.

Figure 3:
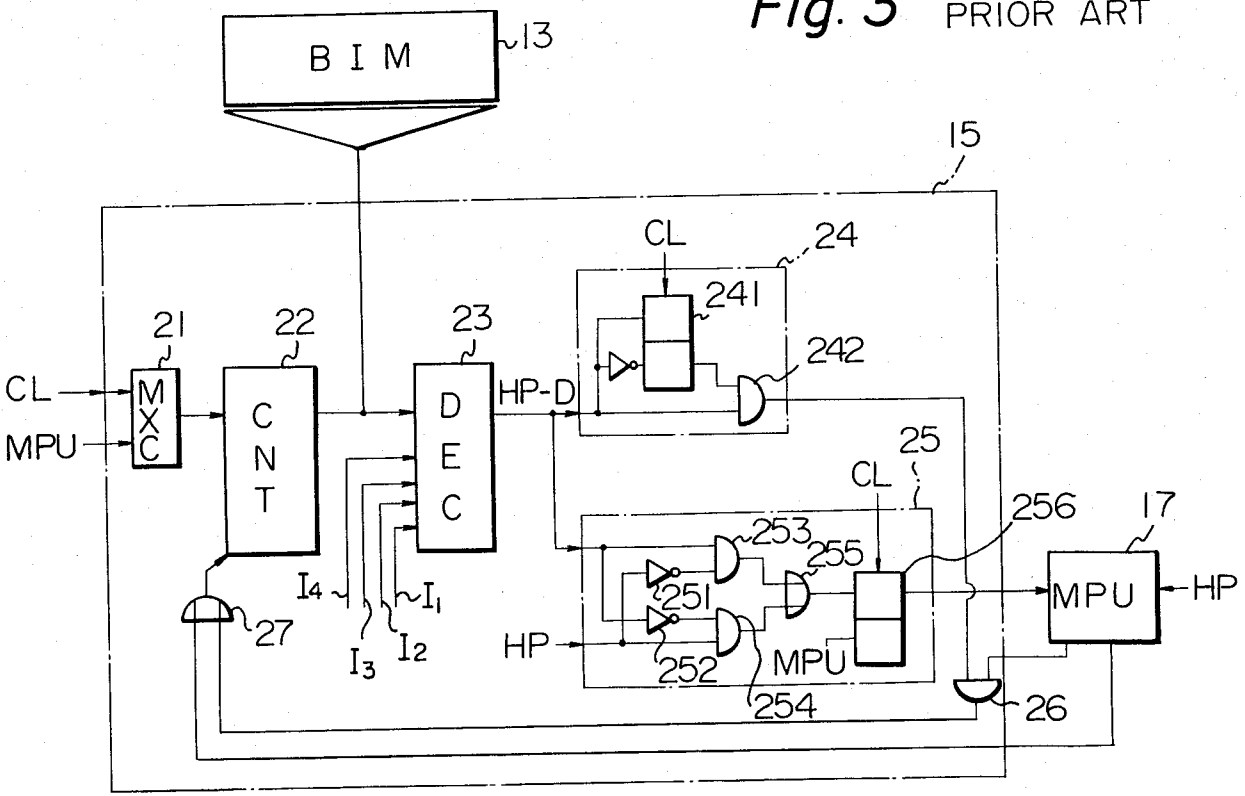
Fig. 3 PRIOR ART
FIG. 3 is a block circuit diagram of a prior art belt synchronous circuit.

FIG. 3 is a block circuit diagram of a prior art belt synchronous circuit between the type-belt 1 and the BIM 13. In FIG. 3, reference numeral 12 designates a multiplex channel (MXC); 22 a counter; 23 a decoder for the counter value of the counter 22; 24 a matching circuit comprising a pulse generating circuit; and 25 a determination circuit for determining whether or not the belt synchronization is normal or abnormal.

The matching circuit 24 comprises a flip-flop 241 and an AND circuit 242. The determination circuit 25 comprises two inverters 251, 252, two AND circuits 253 and 254, an OR circuit 255, and a flip-flop 256.

In addition, reference numeral 26 designates an AND circuit and 27 an OR circuit for transmitting a clear signal from the AND circuit 26 or the MPU 17 to the counter 22.

Input lines $I_1$, $I_2$, $I_3$, and $I_4$ of the decoder 23 are used for selecting a particular type-belt, such as a 48 character type-belt, a 64-character type-belt, a 96-character type-belt, and a 128-character type-belt, respectively.

The synchronous check operation of the circuit of FIG. 3 between the type-belt 1 and the address of the BIM 13 will now be explained. It is assumed that the flip-flops 241 and 256 are reset by the MPU 17.

First, the MPU 17 generates an initial synchronous check instruction, and, as a result, the counter 22 is cleared when the MPU 17 receives the first HP signal from the type-belt 1. In addition, the AND circuit 26 is caused to open. In this state, the type-belt 1 runs to generate CL signals, and accordingly, the counter 22 counts up. In this case, the counter 22 also generates an output indicating an address of the BIM 13.

On the other hand, with respect to the decoder 23, one of the input lines $I_1$, $I_2$, $I_3$, or $I_4$, connected to the decoder 23, is selected. For example, if the input line $I_1$ is selected, the decoder 23 monitors whether or not the counter value of the counter 22 exceeds the predetermined value which is, in this case, 48. If the counter value exceeds the predetermined value, the decoder 23 generates a second home position signal (HP-D signal). The determination circuit 25 compares the HP-D signal from the decoder 23 to the HP signal directly from the type-belt 1.

When the HP-D signal is the same phase as the HP signal, the determination circuit 25 generates no output. However, when the phase of the HP-D signal is different from the HP signal, at least one of the AND circuits 253 or 254 generates an output so as to set the flip-flop 25. As a result, the MPU 17 is informed of such an abnormal state, thus, indicating that there is a possibility of character errors, missed characters, or the like.

Note, if no belt synchronous check is necessary, the MPU 17 closes the AND circuit 26. In addition, in such an abnormal state, if the MPU 17 continues the belt synchronous check, the MPU 17 clears the counter 22 when receiving the next HP signal.

After the MPU 17 performs the belt synchronous check upon all the characters of the type-belt 1 and finds that all the characters are in a normal state, the control proceeds to a normal processing, that is, a data transfer mode, a print mode, and the like. In this case, the AND circuit 26 is open.

The circuit of FIG. 3, however, is disadvantageous in that the number of type-belts available is limited by the number of input lines of the decoder 23. For example, in FIG. 3, the number of type-belts is four.

However, in the present invention, the information regarding the belt synchronous check is stored in the BIM 13, and, accordingly, no decoder 23 is necessary. Since such information of the BIM 13 is voluntarily determined, the number of type-belts is also voluntarily determined.

Figure 4:
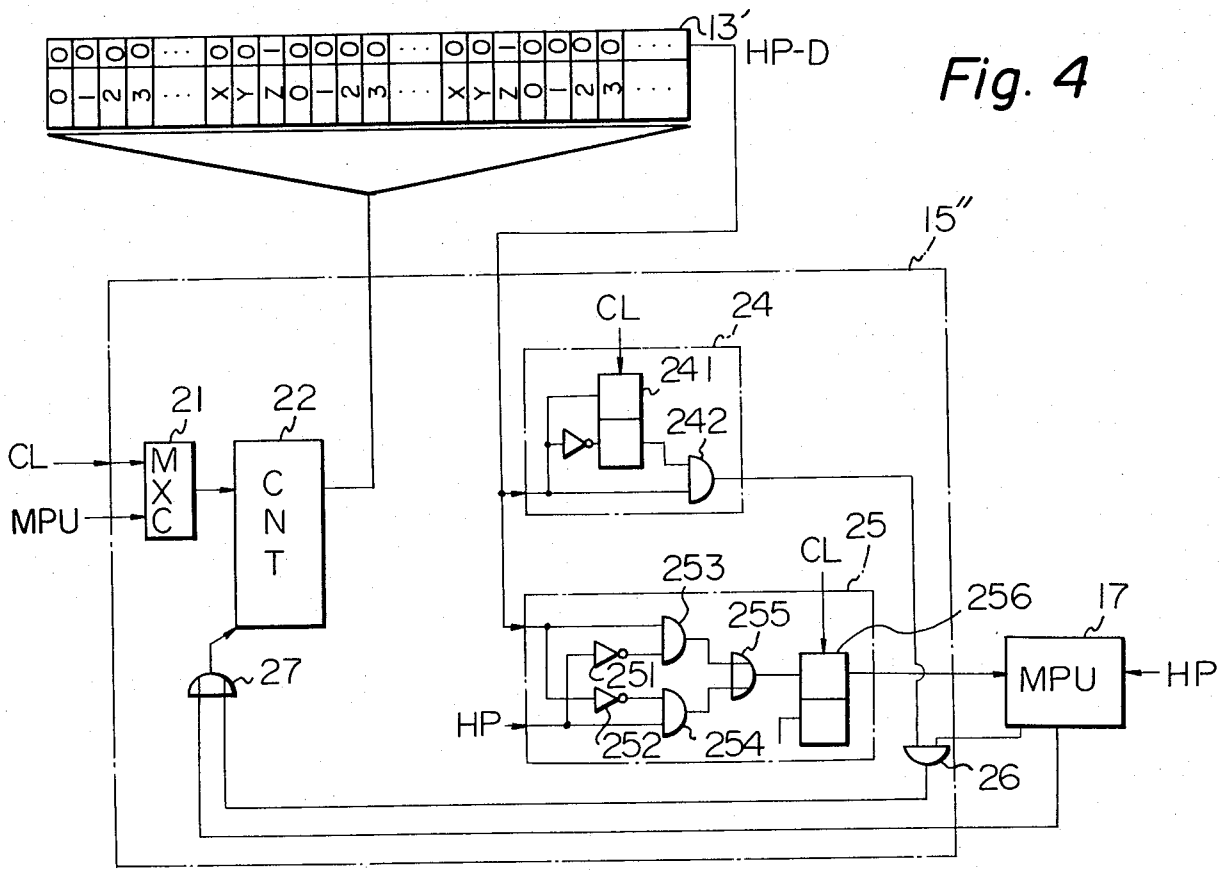
FIG. 4 is a block circuit diagram of an embodiment of the belt synchronous circuit according to the present invention.

FIG. 4 is a block circuit diagram of an embodiment of the belt synchronous circuit according to the present invention. In FIG. 4, the elements which are the same as those of FIG. 3 are denoted by the same reference numerals. In FIG. 4, the BIM 13' also serves as the decoder 23 of FIG. 3, and therefore, the decoder 23 is unnecessary. That is, the information regarding the belt synchronous check is added to each character code of the BIM 13'. For example, such information (flag "1") is inserted at each position corresponding to the first character or the last character of each character set. If a 48-character type-belt is available, the BIM 13' has the information regarding the belt synchronous check comprising forty-seven "0"'s and one "1", alternately. That is, in the BIM 13', the flag "1", corresponding to the above-mentioned HP-D signal, is provided.

The synchronous check operation of the circuit of FIG. 4 between the type-belt 1 and the addresses of the BIM 13' will now be explained. It is also assumed that the flip-flops 241 and 256 are reset by the MPU 17.

First, the MPU 17 generates an initial synchronous check instruction and, as a result, the counter 22 is cleared when the MPU 17 receives the first HP signal from the type-belt 1. The AND circuit 26, in this case, is caused to close. In this state, the type-belt 1 runs to generate CL signals, the counter 22 counts up and generates an output indicating an address of the BIM 13'. When the counter value reaches the predetermined value, the counter 22 generates an address of the last character code of a character set which is, in this case, "Z". As a result, the flag "1" is read out of the BIM 13' and it serves as an HP-D signal. The determination circuit 25 compares the HP-D signal from the BIM 13' to the HP signal directly from the type-belt 1. Note that the determination circuit 25 operates the same way as in FIG. 3. Therefore, when a mismatching occurs in the two signals, the MPU 17 is informed of such a mismatching and indicates that there is a possibility of character errors, missed characters, or the like.

Note that even during the belt synchronous check operation, since the flag "1" is read out of the BIM 13' at the end of the character sets, it is unnecessary to clear the counter 22 at the end of every character set, and, accordingly, the AND circuit 26 is closed.

Thus, since the flag "1" can be written at any position, it is possible to write the flag "1" at positions corresponding to the HP marks of the type-belt 1 when the character codes of a voluntary number of type-belts are written into the BIM 13'. Therefore, a large number of type-belts can be substantially adopted without limitations. Note that in the prior art circuit FIG. 3, the number of of type-belts is limited by the number of input lines of the decoder 23.

I claim:

1. A belt synchronous check system for a line printer including a type-belt having a plurality of character sets each of which has the same characters, the line printer further including first signal generating means for generating signals indicating the locations of individual characters, second signal generating means for generating signals indicating the reference marks of the character sets, and a belt image memory for storing the character codes of the characters, the belt synchronous check system comprising:

counter means, operatively connected to the first signal generating means and the belt image memory, for receiving and counting the signals from the first signal generating means and outputting a signal corresponding to the reference marks of the character sets in the belt image memory;

flag-generating means, provided in the belt image memory and operatively connected to said counter means, for generating flag bits corresponding to the reference marks of the character sets in dependence upon the signal from said counter means corresponding to the reference marks of the character sets;

determination means, operatively connected to said flag-generating means in the belt image memory and to the second signal generating means, for receiving the flag bits and for comparing the flag bits with the signals from the second signal generating means and providing an output signal if the flag bits and the signals from the second signal generating means are the same; and control means, operatively connected to said determination means and said counter means, for receiving the output signal from said determination means and clearing said counter means.

2. A system as set forth in claim 1, wherein the flag bits of said flag-generating means are located at positions in the belt image memory corresponding to the first character of each character set.

3. A system as set forth in claim 1, wherein the flag bits of said flag-generating means are located at positions in the belt image memory corresponding to the last character of each character set.

4. A system as set forth in claim 1, wherein said determination means comprises:

a first inverter, opertively connected to the second signal generating means, for receiving signals from the second signal generating means;

a second inverter, operatively connected to said flag-generating means, for receiving the flag bits from said flag-generating means;

a first AND circuit, operatively connected to said flag-generating means and said first inverter, for receiving the flag bits from said flag-generating means provided in the belt image memory and for providing a first output signal;

a second AND circuit, operatively connected to the second signal generating means and said second inverter, for providing a second output signal;

an OR circuit, operatively connected to receive the first and second output signals of said first and second AND circuits, for providing a third output signal; and a flip-flop, operatively connected to said OR circuit, having a set terminal for receiving the third output signal of said OR circuit, having a reset terminal operatively connected to said control means, and having a clock terminal operatively connected to the first signal generating means.

5. A belt synchronous check system for a line printer including a type-belt having a plurality of character sets each having the same characters, the line printer further including first signal generating means for generating signals indicating the locations of individual characters and second signal generating means for generating signals indicating the reference marks of the character sets, the belt synchronous check system comprising:

counter means, operatively connected to the first signal generating means, for receiving and counting the signals from the first signal generating means;

a belt image memory, operatively connected to said counter means, for storing character codes of the characters, including flag generating means for generating flag bits corresponding to the reference marks of the character sets;

determination means, operatively connected to said belt image memory and the second signal generating means, for comparing one of the generated flag bits from said flag generating means with a signal from the second signal generating means and providing an output signal if the flag bit and the signal from the second signal generating means are the same; and control means, operatively connected to said determination means and said counter means, for receiving the output signal from said determination means and clearing said counter means.

* * * * *